United States Patent [19]

Dunlap et al.

[11] Patent Number: 4,609,610

[45] Date of Patent: Sep. 2, 1986

[54] PHOTOGRAPHIC PRODUCTS EMPLOYING NOVEL NONDIFFUSIBLE COMPOUNDS WHICH RELEASE PHOTOGRAPHICALLY USEFUL GROUPS

[75] Inventors: Richard P. Dunlap; Thomas E. Gompf, both of Penfield, N.Y.

[73] Assignee: Eastman Kodak Company, Rochester, N.Y.

[21] Appl. No.: 761,280

[22] Filed: Aug. 1, 1985

[51] Int. Cl.[4] ..... G03C 1/40; G03C 5/54; G03C 1/08; G03C 1/34

[52] U.S. Cl. ..... 430/223; 430/212; 430/218; 430/219; 430/222; 430/542; 430/559; 430/562; 430/564; 430/566; 430/570; 430/598; 430/599; 430/606; 430/607; 430/621; 430/955; 430/957

[58] Field of Search ..... 430/218, 219, 223, 955, 430/957, 222, 212, 542, 559, 562, 564, 566, 598, 599, 570, 606, 607, 621

[56] References Cited

U.S. PATENT DOCUMENTS

| | | | |
|---|---|---|---|
| 4,009,029 | 2/1977 | Hammond et al. | 430/219 |
| 4,139,379 | 2/1979 | Chasman et al. | 430/223 |
| 4,199,354 | 4/1980 | Hinshaw et al. | 430/223 |
| 4,307,175 | 12/1981 | Pollet et al. | 430/219 |
| 4,468,449 | 8/1984 | Arbree et al. | 430/955 |
| 4,468,450 | 8/1984 | Meneghini et al. | 430/955 |
| 4,511,644 | 4/1985 | Okamura et al. | 430/219 |

FOREIGN PATENT DOCUMENTS

| | | | |
|---|---|---|---|
| 2427183 | 12/1974 | Fed. Rep. of Germany | 430/219 |

*Primary Examiner*—Richard L. Schilling
*Attorney, Agent, or Firm*—Thomas F. Kirchoff

[57] ABSTRACT

Photographic elements and assemblages are described which employ nondiffusible compounds which release photographically useful groups in an imagewise manner as the result of a $\beta$-elimination reaction.

17 Claims, No Drawings

PHOTOGRAPHIC PRODUCTS EMPLOYING NOVEL NONDIFFUSIBLE COMPOUNDS WHICH RELEASE PHOTOGRAPHICALLY USEFUL GROUPS

This invention relates to photography and more particularly to color diffusion transfer photography employing novel nondiffusible compounds capable of releasing photographically useful groups in an imagewise manner as a function of a $\beta$-elimination reaction.

Various means are known for releasing a photographically useful group (PUG), particularly during processing of photographic diffusion transfer recording materials. One means, which is described in U.S. Pat. No. 4,199,354, is based on a positive-working system and yields a positive transfer image using a negative emulsion. This patent relates to ballasted benzisoxazolone compounds which release diffusible image dye-providing moieties as a result of an intramolecular nucleophilic displacement reaction.

Another means, described in U.S. Pat. No. 4,139,379, relates to ballasted electron accepting nucleophilic displacement compounds which, after acceptance of at least one electron, undergo intramolecular nucleophilic displacement to release a diffusible PUG.

U.S. Pat. No. 4,009,029 discloses use of a blocked development restrainer compound which releases a heterocyclic image stabilizer moiety in diffusion transfer photographic recording material as the result of a $\beta$-elimination reaction. However, elimination of such moiety is accomplished in a non-imagewise manner.

It is desirable to provide nondiffusible compounds which are capable of imagewise release of photographically useful groups in either a positive-working or a negative-working manner.

A photographic element according to this invention comprises a support having thereon at least one photosensitive silver halide emulsion layer having associated therewith a nondiffusible compound capable of releasing a diffusible photographically useful group in an imagewise manner by a $\beta$-elimination reaction, which compound has the structural formula:

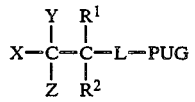

wherein:

X is an electron-withdrawing group;

Y is hydroxy, $—NH_2$, an unsubstituted or a substituted alkyl group having from 1 to about 30 carbon atoms, or an unsubstituted or substituted aryl group having from 6 to about 30 carbon atoms;

Z is hydrogen, an unsubstituted or a substituted alkyl group having from 1 to about 30 carbon atoms, an unsubtituted or a substituted aryl group having from 6 to about 30 carbon atoms, or an electron-withdrawing group;

when Z is hydrogen, X is linked to the carbon atom to which Z is appended through a carbonyl or a sulfonyl group; and when Z is not hydrogen, at least one of X and Z is $NO_2$;

$R^1$ and $R^2$ are each independently hydrogen, a saturated or an unsaturated, unsubstituted or a substituted, straight or branched chain aliphatic group having from 1 to about 30 carbon atoms;

an alicyclic group having from 4 to about 30 total carbon atoms;

a heterocyclic group having from 5 to 7 atoms in the heterocyclic ring;

an aromatic group, which may be substituted, having from 6 to about 30 carbon atoms; or at least one of $R^1$ and $R^2$ and the carbon atom to which they are attached, or at least one of $R^1$ and $R^2$, the carbon atom to which they are attached along with Y and the carbon atom to which it is attached, can constitute the atoms necessary to form a mono- or a poly-cyclic group having 5 or 6 atoms in each ring;

$R^1$ and $R^2$, either independently or taken together, can represent a group having from about 8 to about 30 carbon atoms;

with the proviso that at least one of $R^1$, $R^2$ and Y represents a ballast group;

L is a leaving group; and

PUG is a photographically useful group.

Electron-withdrawing groups which can be represented by X and Z include: $—NO_2$, $—COR^3$, $—CONHR^3$, $—SO_2R^3$ and $—SO_2NHR^3$ where $R^3$ is hydrogen, a saturated or an unsaturated, straight or branched chain aliphatic group having from 1 to about 30 carbon atoms;

an alicyclic group having from 4 to about 30 total carbon atoms;

a heterocyclic group having from 5 to 7 atoms in the heterocyclic ring; or an aromatic group, which may be substituted, having from 6 to about 30 carbon atoms;

L can be oxygen, sulfur or nitrogen; or L can be a divalent saccharin or phthalimide group where PUG is appended to the benzene ring of such group.

Divalent saccharin compounds which can be used in this manner are disclosed in U.S. Pat. Nos. 4,410,618 and 4,263,393, the disclosures of which are hereby incorporated by reference.

Suitable aliphatic groups which can be represented by $R^1$, $R^2$ or $R^3$ are saturated or unsaturated straight or branched chain alkyl groups of from 1 to about 30 carbon atoms, including aralkyl and aryloxyalkyl groups, such as for example methyl, butyl, dodecyl, benzyl or phenoxypropyl.

Suitable alicyclic groups which can be represented by $R^1$, $R^2$ or $R^3$ include cycloalkyl groups of from about 4 to about 30 carbon atoms such as for example cyclopropyl, cyclohexyl, cyclododecyl or cyclooctadecyl.

Suitable heterocyclic groups which can be represented by $R^1$, $R^2$ or $R^3$ are those having from 5 to 7 atoms in the heterocyclic ring and include, for example, pyridine, furan and thiophene rings.

Suitable aromatic groups which can be represented by $R^1$, $R^2$, or $R^3$ are those having from 6 to about 30 carbon atoms and include alkaryl and alkoxyaryl groups such as for example phenyl, naphthyl, tolyl or butoxyphenyl.

In a particularly preferred embodiment, $R^1$ and $R^2$ each represents straight chain alkyl groups having from about 10 to about 22 carbon atoms, such as decyl, dodecyl, pentadecyl and octadecyl.

Substituents which can be present on the above-noted heterocyclic or aromatic groups include alkyl or alkoxy groups having from 1 to about 5 carbon atoms, halogen atoms such as chloro and bromo, nitro, hydroxy and amino, including substituted amino groups, sulfoalkyl, carbamoyl and sulfamoyl groups.

Nondiffusibility of the compounds described in this invention is imparted by ballast groups. Ballast groups, which can be represented by one or more of $R^1$, $R^2$ and Y, are organic radicals of such molecular size and configuration as to render the compound non-diffusible in a photographic element during development in an alkaline processing composition. The nature of the ballast group is not critical so long as it confers nondiffusibility to the compound. Typical ballast groups include long-chain alkyl radicals having at least 8 and as many as about 30 carbon atoms. These groups are linked directly or indirectly to the compound. Ballast groups also include aromatic radicals of the benzene and naphthalene series attached directly or indirectly to the compound.

PUG groups can be a dye, a dye precursor, or a photographic reagent such as a development inhibitor, a development accelerator, a bleach inhibitor, a bleach accelerator, a developing agent, a silver halide solvent, a silver complexing agent, a fixing agent, a toning agent, a hardening agent, a fogging or an antifogging agent, or a chemical or a spectral sensitizing or desensitizing agent.

A preferred nondiffusible positive redox releasing compound suitable for use in the photographic elements and assemblages of this invention is a gem-dinitro compound having the structural formula:

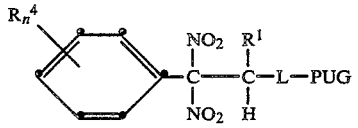

wherein:

$R^1$, L and PUG are as defined above;

$R^4$ is chloro, nitro, an unsubstituted or substituted alkyl group having from 1 to about 22 total carbon atoms, $-SO_2R^5$ or $-SO_2NHR^5$;

$R^5$ is an unsubstituted or a substituted alkyl group having from 1 to about 6 carbon atoms; and n is an integer from 0 to 3.

The $\beta$-elimination reaction by which a photographically useful group (PUG) is released from the compounds of this invention is a base-catalyzed reaction whereby two groups are lost from adjacent ($\alpha$,$\beta$) atoms to form a new double bond. This reaction is illustrated by the following:

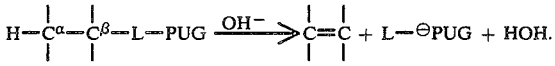

The concentration of compound capable of releasing a PUG in an imagewise manner by a $\beta$-elimination reaction may be varied over a wide range, depending upon the particular compound employed and the results which are desired. For example, where a compound is employed which releases an image dye or image dye precursor compound, it may be coated in layers at concentrations of from about 0.1 to about 3 g/m$^2$. This can be accomplished by using coating solutions containing between about 0.5 to about 8 percent by weight of the dye-releasing compound distributed in a hydrophilic film-forming natural material or synthetic polymer, such as gelatin or poly(vinyl alcohol), which is adapated to be permeated by aqueous alkaline processing composition.

When the PUG which is to be released is a photographic reagent, rather than a dye or a dye precursor, smaller amounts of the compound are needed. In such instances the compound may be coated in layers at concentrations of from about 0.01 to about 0.5 g/m$^2$.

The preferred gem-dinitro compounds noted above are positive redox releasing compounds that undergo a reduction reaction to form a positive transferred dye-image using negative emulsions. These compounds are coated in the photographic element in their oxidized form and require an electron source for reduction. This source can be an electron donor compound of the types described in U.S. Pat. Nos. 4,139,379 and 4,278,750, the disclosures of which are incorporated herein by reference.

In areas of exposed silver halide, oxidized electron transfer agent (developing agent), which is formed by reduction of the exposed silver halide, oxidizes the electron donor compound. This oxidation prevents the electron donor from reducing the gem-dinitro compound.

In non-exposed areas the electron donor compound is available to reduce the gem-dinitro compound which then undergoes the $\beta$-elimination reaction with subsequent release of the photographically useful group (PUG).

Redox releasing compounds falling within the structural formulae noted above include the following:

(A) Where PUG is a dye or a dye precursor compound.

1.
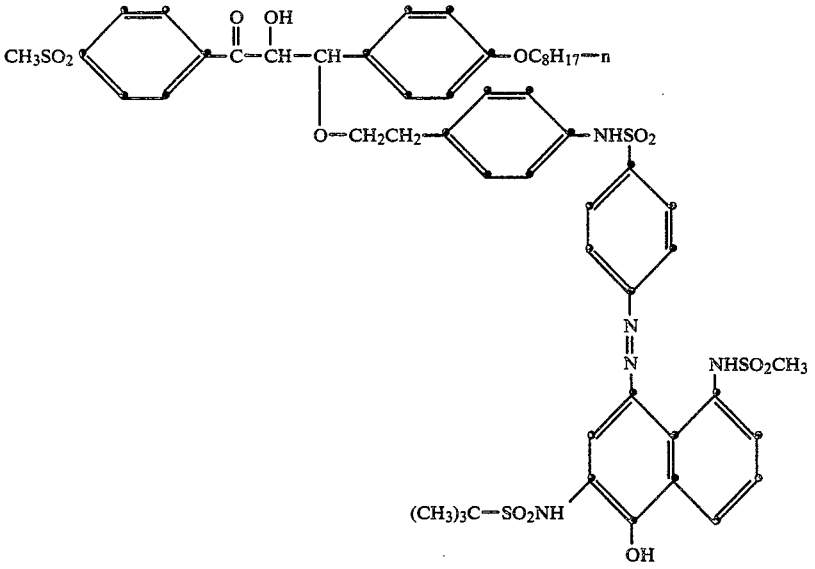
2.
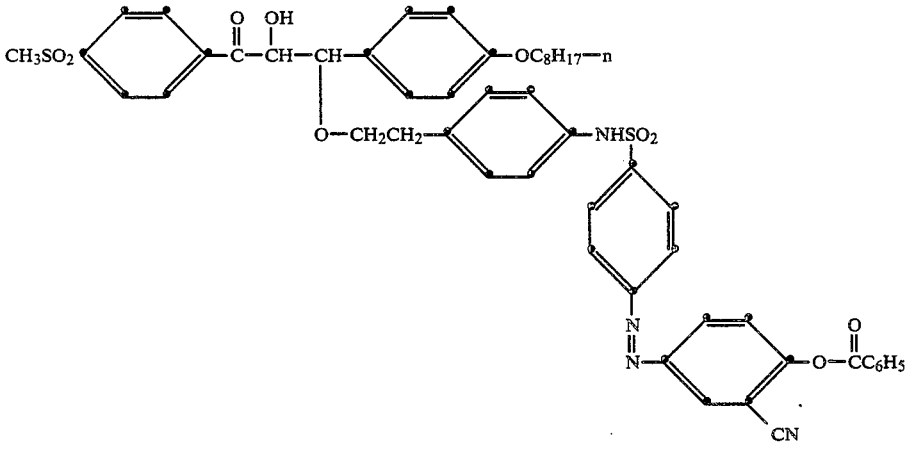
3.
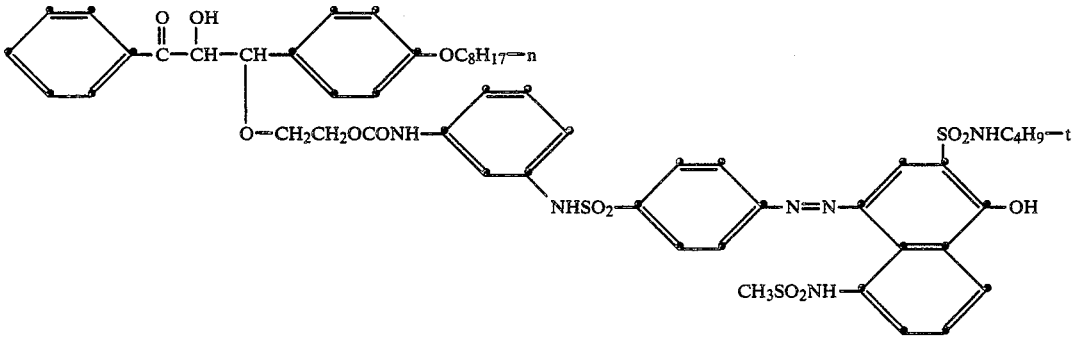

-continued
4.
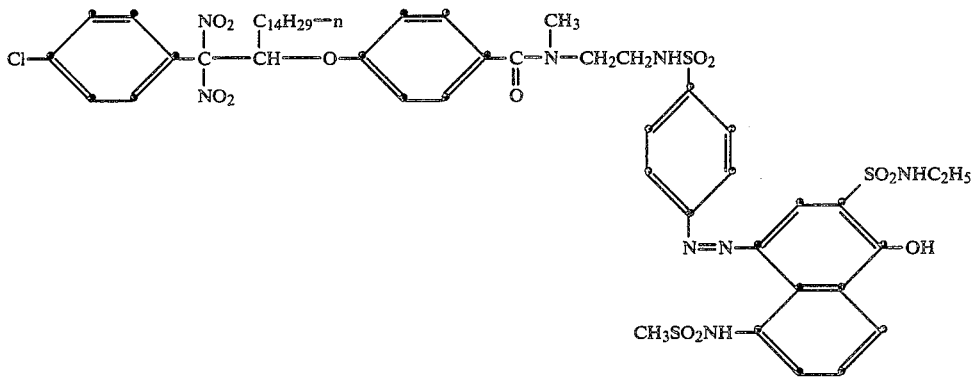
5.
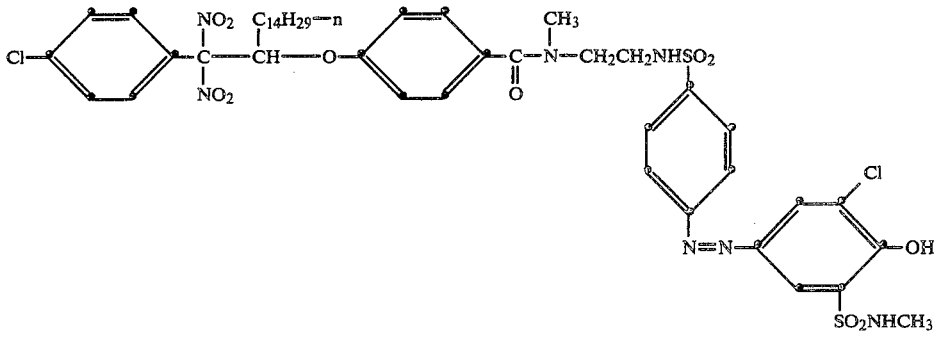
6.
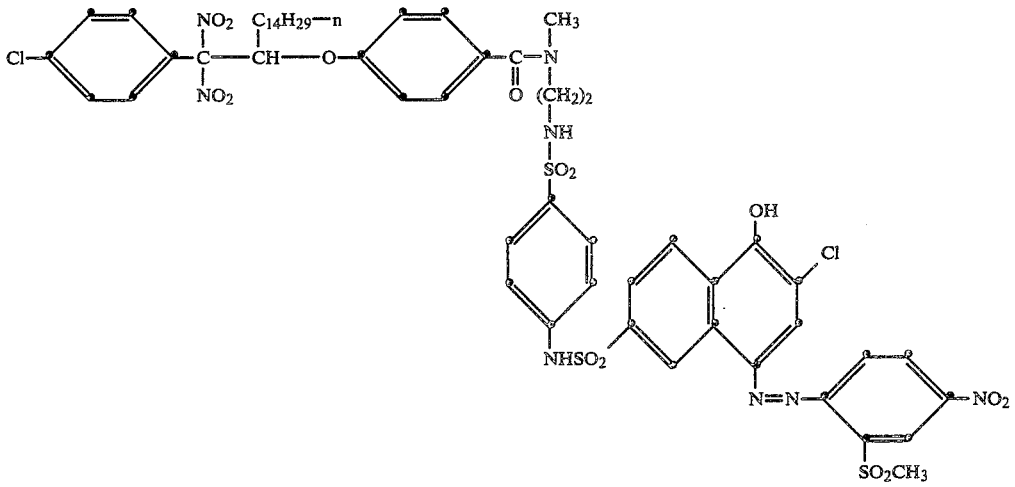
7.
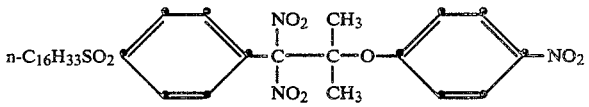
8.
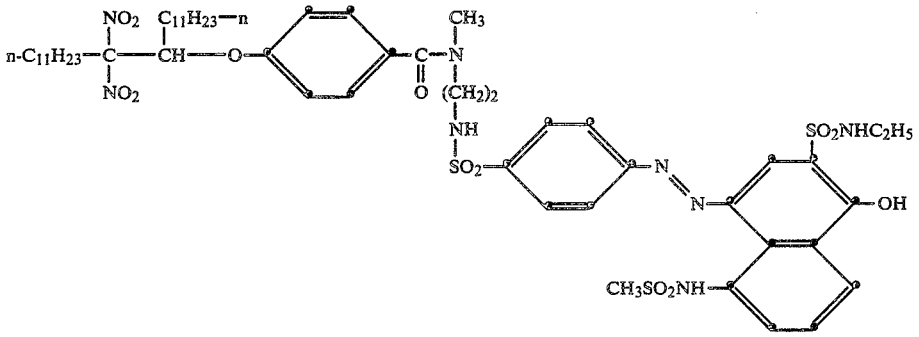

-continued
9.
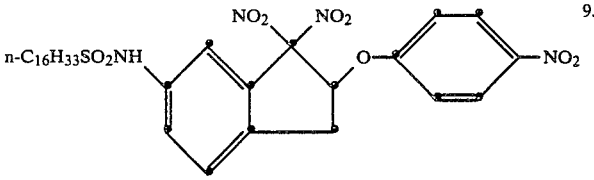
10.
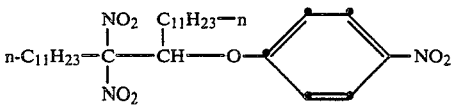
11.
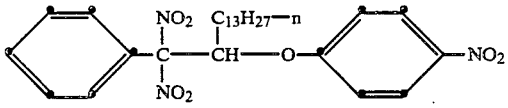
12.
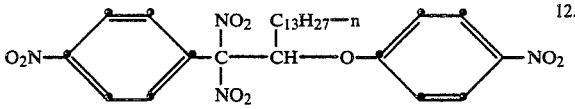
(B) Where PUG is a photographic reagent.
13.
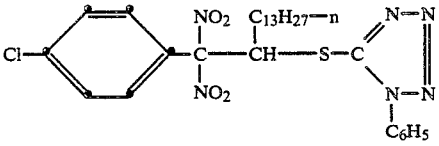
14.
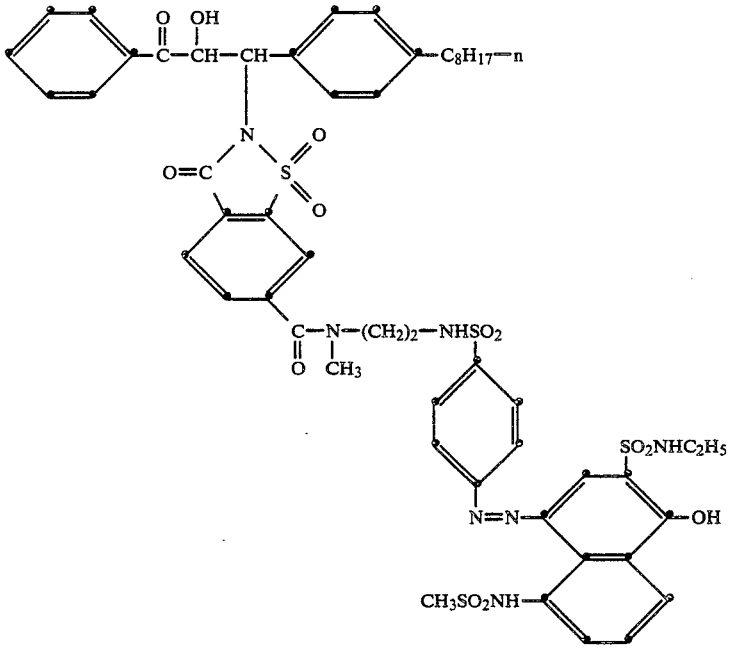
15.
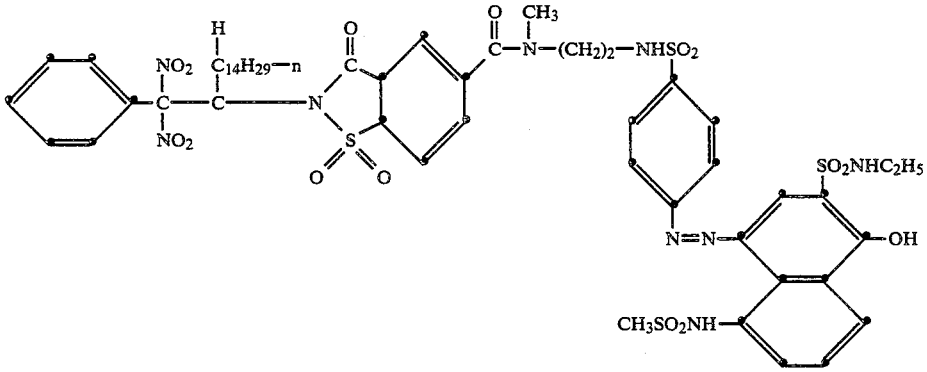

-continued

16.

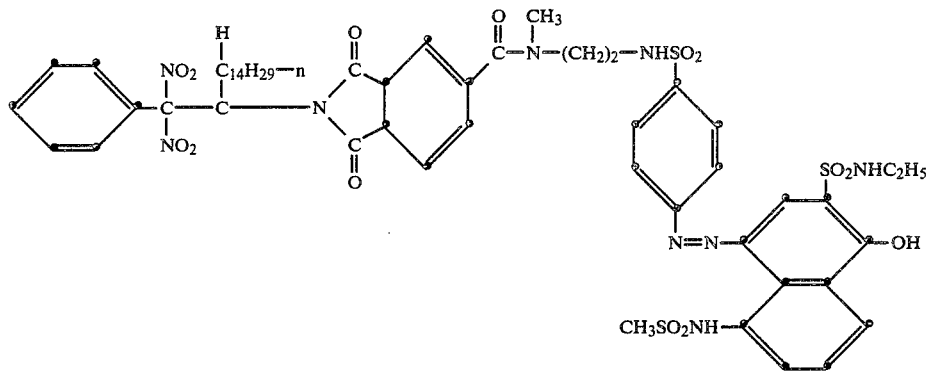

The photographic elements described above can be treated in any manner with alkaline processing composition to effect or initiate development. A preferred method for applying processing composition is by use of a rupturable container or pod which contains the composition. The processing composition can contain the developing agent, although the composition could be an alkaline solution with the developing agent being incorporated in the photographic element or cover sheet. In the latter case the alkaline solution serves to activate the incorporated developer.

A photographic assemblage in accordance with this invention comprises:

(a) a photographic element comprising a nondiffusible compound capable of releasing a photographically useful group in an imagewise manner by a $\beta$-elimination reaction as described above;

(b) a dye image-receiving layer; and (c) an alkaline processing composition with means for discharging same within said assemblage;

said assemblage also comprising a silver halide developing agent.

The processing composition may be inserted into the assemblage by interjecting processing solution with communicating members similar to hypodermic syringes which are attached either to a camera or camera cartridge. The processing composition can also be applied by means of a swab or by dipping into a bath. Another method of applying processing composition in the assemblage is the liquid spreading means described in U.S. Pat. No. 4,370,407.

The assemblage itself preferably contains the alkaline processing composition and means containing same for discharge within the assemblage. There can be employed, for example, a rupturable container which is adapted to be positioned during processing so that a compressive force applied to the container by pressure-applying members, such as would be found in a camera designed for in-camera processing, will effect a discharge of the container's contents within the assemblage.

Image-receiving layers which can be employed with the compounds of this invention can be any of those recognized in the art as providing the desired functions of mordanting or otherwise fixing the dye images. The choice of mordant will, at least in part, depend upon the dye to be mordanted and can be a basic polymeric mordant, such as described in U.S. Pat. Nos. 2,882,156; 3,625,694; 3,709,690; 3,898,088; 3,958,995; 3,859,096; or in the November 1976 edition of Research Disclosure, pages 80–82, the disclosures of which are hereby incorporated by reference.

The dye image-receiving layer in the above-described assemblage is optionally located on a separate support adapted to be superposed on the photographic element after exposure thereof. Such an image-receiving element is generally disclosed in U.S. Pat. No. 3,362,819. When the means for discharging processing composition is a rupturable container, it is usually positioned in relation to the photographic element and the image-receiving layer so that a compressive force applied to the container by pressure-applying members, such as would be found in a typical camera used for in-camera processing, will effect a discharge of the container's contents between the image-receiving layer and the outermost layer of the photographic element. After processing, the dye image-receiving layer is separated from the photographic element.

In another embodiment the dye image-receiving layer in the above-described assemblage is located integral with the photographic element and is located between the support and the lowermost photosensitive silver halide emulsion layer. One useful format for integral imaging receiver photographic elements is disclosed in Belgian Pat. No. 757,960. Another format for integral imaging receiver photographic elements in which the present invention is useful is disclosed in Canadian Pat. No. 928,559.

Still other useful integral formats in which this invention can be employed are described in U.S. Pat. Nos. 3,415,644; 3,415,645; 3,415,646; 3,647,437 and 3,635,707. In most of these formats, a photosensitive silver halide emulsion is coated on an opaque support and a dye image-receiving layer is located on a separate transparent support superposed over the layer outermost from the opaque support. In addition, this transparent support also preferably contains a neutralizing layer and a timing layer underneath the dye image-receiving layer.

A preferred photographic assemblage in accordance with the invention comprises:

(a) a photographic element comprising a support having thereon the following layers in sequence: a dye image-receiving layer, a stripping layer, a substantially opaque layer and a photosensitive silver halide emulsion layer having associated therewith a nondiffusible compound capable of releasing a photographically useful group in an imagewise manner by a $\beta$-elimination reaction, said compound being as described above;

(b) a transparent cover sheet superposed over the silver halide emulsion layer; and (c) an opaque alkaline processing composition and means containing same for discharge, during processing, between the cover sheet and the photosensitive element;

said assemblage also comprising a silver halide developing agent.

Any material may be employed as the stripping layer in the photographic assemblage described above provided it will perform the desired function of cleanly stripping. Such materials are disclosed, for example in U.S. Pat. Nos. 3,220,835; 3,730,718; and 3,820,999 and include gum arabic, sodium alginate, pectin, polyvinyl alcohol and hydroxyethyl cellulose. Hydroxyethyl cellulose is preferably employed as the stripping layer.

The stripping layer materials employed in the assemblage described above can be employed in any amount which is effective for the intended purpose. Good results are obtained at a concentration of from about 5 to about 2000 mg/m$^2$ of element. The particular amount to be employed will vary depending on the particular stripping layer material employed and the nature of the other layers of the diffusion transfer element.

The photographic element or assemblage of the present invention can be used to produce positive images in single or multicolors. In a three-color system, each silver halide emulsion layer can have associated therewith a compound having a PUG which releases an image dye or a dye precursor compound as described above. Each released image dye possesses a predominant spectral absorption within the region of the visible spectrum to which said silver halide emulsion is sensitive. For example, the blue-sensitive silver halide emulsion layer will have a yellow dye-releaser associated therewith, the green-sensitive silver halide emulsion layer will have a magenta dye-releaser associated therewith and the red-sensitive silver halide emulsion layer will have a cyan dye-releaser associated therewith. The dye releasing compound associated with each silver halide emulsion layer is contained either in the silver halide emulsion layer itself or in a layer contiguous to the silver halide emulsion layer, i.e., the dye releasing compound can be coated in a separate layer underneath the silver halide emulsion layer with respect to the exposure direction.

The silver halide emulsion layers which can be employed in the photographic elements of this invention can be disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layers for absorbing or filtering blue radiation that is transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

Generally speaking, except where noted otherwise, the silver halide emulsion layers employed comprise photosensitive silver halide dispersed, together with the above described compounds capable of releasing photographically useful groups, in gelatin or another aqueous alkaline solution-permeable polymeric binder. These layers are about 0.6 to 7 microns in thickness. These thicknesses are approximate only and can be modified according to the product desired. The silver halide emulsions and the compounds capable of releasing the desired dyes may also be coated in separate layers.

It will be appreciated that when the photographically useful group is a dye, after processing of the photographic element there remains in it after transfer has taken place an imagewise distribution of dye in addition to developed silver. A color image comprising residual nondiffusible compound is obtained if the residual silver and silver halide are removed by any conventional manner well known to those skilled in the photographic art, such as a bleach bath, followed by a fix bath, a bleach-fix bath, etc. The imagewise distribution of dye may also diffuse out of the element into these baths, if desired, rather than to an image-receiving element. If a negative-working silver halide emulsion is employed a positive color image, such as a reflection print, a color transparency or a motion picture film can be produced in this manner. If a direct-positive silver halide emulsion is employed in such photosensitive elements, then a negative color image is produced.

Where the photographically useful group which is to be released is other than a dye or a dye precursor, the compound containing the PUG can be dispersed in a gelatin layer or in another aqueous alkaline solution-permeable polymeric binder layer. The location of such layer will depend upon the nature of the PUG to be released and its desired location, at the time of release, in the photographic element or assemblage.

Use of a neutralizing material in the photographic assemblages of this invention will usually increase the stability of the transferred image. Generally, the neutralizing material will effect a reduction in the pH of the image layer from about 13 or 14 to at least 11 and preferably 5 to 8 within a short time after treatment with alkali. Suitable materials and their functioning are disclosed on pages 22 and 23 of the July 1974 edition of *Research Disclosure,* and pages 35 though 37 of the July 1975 edition of *Research Disclosure,* the disclosures of which are hereby incorporated by reference.

A timing or inert spacer layer can be employed over the neutralizing layer which "times" or controls the pH reduction as a function of the rate at which alkali diffuses through the inert spacer layer. Examples of such timing layers and their functioning are disclosed in the *Research Disclosure* articles mentioned in the paragraph above concerning neutralizing layers.

The alkaline processing composition employed in this invention is the conventional aqueous solution of an alkaline material, e.g. alkali metal hydroxides or carbonates such as sodium hydroxide, sodium carbonate or an amine such as diethylamine, preferably possessing a pH in excess of 11, and preferably containing a developing agent as described previously. Suitable materials and addenda frequently added to such compositions are disclosed on pages 79 and 80 of the November, 1976 edition of *Research Disclosure,* the disclosure of which is hereby incorporated by reference.

The alkaline solution permeable, substantially opaque, light-reflective layer employed in certain embodiments of photographic elements used in this invention is described more fully in the November 1976 edition of *Research Disclosure,* page 82, the disclosure of which is hereby incorporated by reference.

A variety of silver halide developing agents or electron transfer agents (ETA's) can be used in this invention. Examples of such agents include hydroquinone compounds, aminophenol compounds, catechol compounds, or phenylenediamine compounds.

Highly preferred are 3-pyrazolidinone ETA compounds. The developing agents or ETA compounds are employed in the liquid processing composition or are contained, at least in part, in a layer or layers of the photographic element or assemblage to be activated by the alkaline processing composition. Such layer or layers include silver halide emulsion layers, dye image-providing material layers, interlayers or image-receiving layers.

The supports for the photographic elements used in this invention can be any material, as long as it does not deleteriously affect the photographic properties of the film unit and is dimensionally stable. Typical flexible sheet materials are described on page 85 of the November, 1976 edition of *Research Disclosure,* the disclosure of which is hereby incorporated by reference.

The silver halide emulsions useful in this invention, both negative-working and direct-positive types, are well known to those skilled in the art and are described in *Research Disclosure,* Volume 176, December 1978, Item 17643, pages 22 and 23, "Emulsion preparation and types"; they are usually chemically and spectrally sensitized as described on page 23, "Chemical sensitization", and "Spectral sensitization and desensitization", of the above article; they are optionally protected against the production of fog and stabilized against loss of sensitivity during keeping by employing the materials described on pages 24 and 25, "Antifoggants and stabilizers", of the above article.

The term "nondiffusing" used herein has the meaning commonly applied to the term in photography and denotes materials that for all practical purposes do not migrate or wander through organic colloid layers, such as gelatin, in the described photographic recording materials in an alkaline medium, and preferably when processed in a medium having a pH of 11 or greater. The same meaning is to be attached to the term "immobile". The term "diffusible" has the converse meaning and denotes materials having the property of diffusing effectively through the colloid layers of the photographic recording materials in an alkaline medium. "Mobile" has the same meaning as "diffusible".

The term "in reactive association" is intended to mean that the materials can be in either the same or different layers, so long as the materials are accessible to one another.

The following examples are representative of the preparation of compounds of this invention. Other compounds falling within the scope of this invention can be prepared in similar manner. Unless otherwise indicated all parts, percents and ratios are by weight.

Synthesis of Compound 1

This example describes the preparation of Compound No. 1. A schematic representation of the reactions involved is shown below:

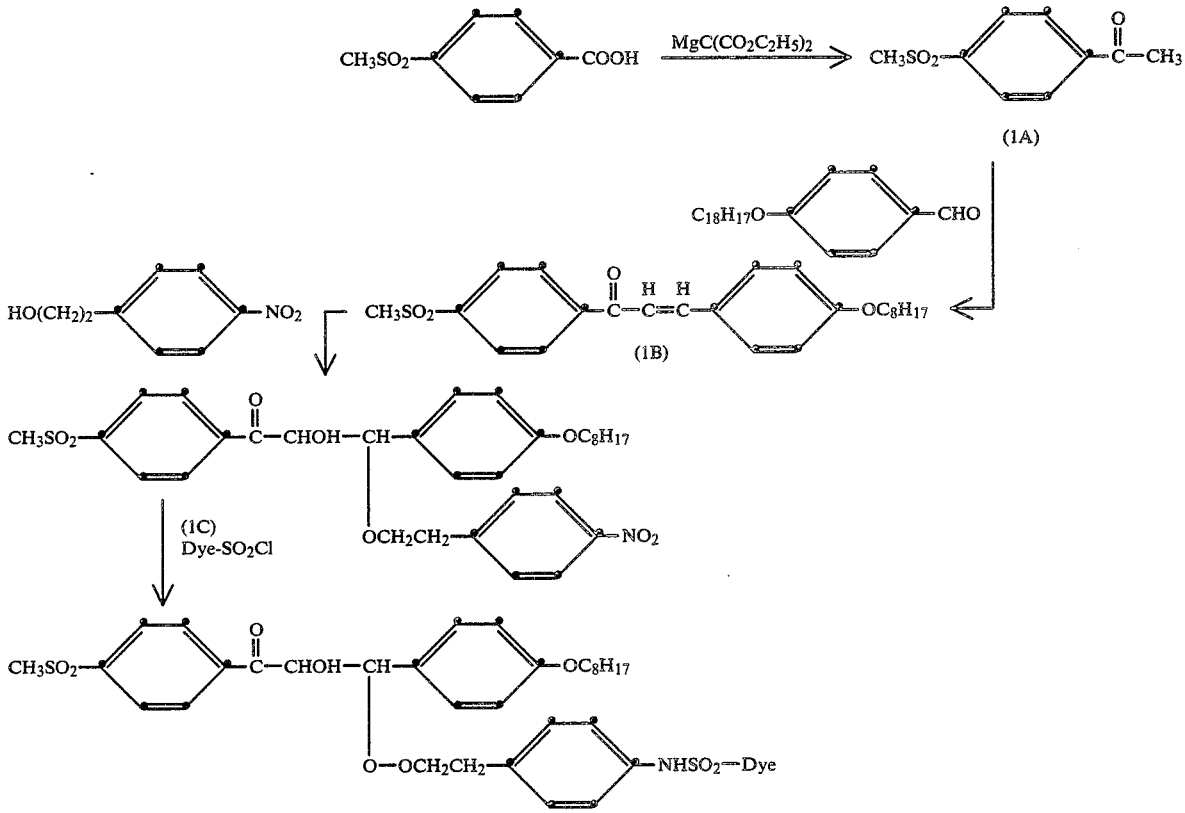

(Compound 1)

Where

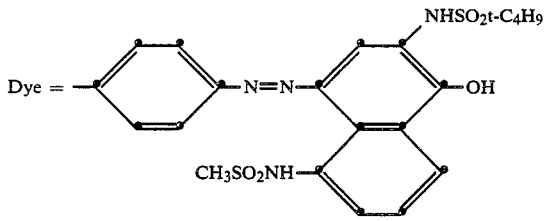

Synthesis of Acetophenone Intermediate 1A:

To distilled thionyl chloride (60. ml) was added in sequence p-methylsulfonylbenzoic acid (50 g), chloroform (150. ml), and dimethylformamide (1. ml). The mixture was heated at reflux for two hours, then cooled, and the solvents were removed by evaporation. The residual solid (p-methylsulfonylbenzoyl chloride) was dissolved in boiling benzene (50. ml) and filtered.

Magnesium filings (16. g), absolute ethanol (15. ml), and carbon tetrachloride (3.0 ml) were carefully mixed. After the reaction subsided, diethyl ether (440. ml), and a solution of diethyl malonate (103. ml) in ethanol (59. ml) were added. The mixture soon came to a vigorous reflux which was maintained for three hours. The reaction mixture was cooled and the hot benzene solution of p-methylsulfonylbenzoyl chloride was added with stirring at a moderate rate and heating to reflux. The gelatinous solution was allowed to stand overnight and was then acidified with dilute sulfuric acid. The organic layer was separated, dried, and the solvent removed by evaporation. The residue was dissolved in glacial acetic acid (250. ml), water (50. ml), and concentrated sulfuric acid (22. ml), refluxed for four hours, poured into ice (4. l), and neutralized with sodium bicarbonate. The neutralized mixture was first extracted with diethyl ether (6. l) and then with hot chloroform (1. l). The chloroform layer was separated and the solvent removed by evaporation. The resulting oil was diluted with ethanol to 250 ml, heated to reflux, and then cooled to −20° C. After removal of solvent, the solids from both the ether and chloroform extracts yielded 36. g (72%) of 1A.

Intermediate 1B

To the intermediate, 1A, at 0° C. was added p-octoxybenzaldehyde (100. ml). A solution of sodium hydroxide (7. 1 g) in water (100. ml) was then added, the solution was allowed to stand for one hour, filtered, and the solid product was washed with ethanol and pentane to yield 37. g of 1B. The filtrate was stirred in additional three hours and an additional 16. g of the intermediate 1B was precipitated. The combined solids were recrystallized from acetonitrile to yield long yellow needles.

Intermediate 1C

To the interemediate 1B, mixed with dioxane (500. ml) was added 32% hydrogen peroxide solution (20. ml) and 40% benzyltrimethylammonium hydroxide in methanol (12. ml). The solution was allowed to stand for 30 minutes, and the pH was reduced to 7.5 with pH 5 acetate buffer. Water was added and a white precipitate of epoxyketone was collected by filtration, and was washed several times with water.

To the epoxyketone (6.8 g) was added p-nitrophenethyl alcohol (1.0 eq) in acetonitrile (20. ml) and concentrated sulfuric acid (1. drop). The resulting solution was poured into pH 7 phosphate buffer, extracted with chloroform, dried, and the solvent removed by evaporation. The residue was dissolved in ethanol, cooled to −20° C., and the ethanol was decanted. Upon addition of a mixture of toluene and pentane a precipitate was obtained. The precipitate was purified by chromatography on silica gel and elution with acetonitrile:-water (1:1) to yield 1C.

Compound 1

To the nitro intermediate, 1C (2.0 g), dissolved in tetrahydrofuran (90. ml), was added 1.0 M hydrochloric acid (4.0 ml) and a small portion of 10% platinum on carbon. After two hours on a Parr Shaker at 206.85 k Pa (30 psi), the hydrogen uptake was 90% of theoretical. The reaction mixture was neutralized, extracted with chloroform, dried, and the solvent was removed by evaporation. To the solid residue was added acetonitrile (100. ml), dimethylaniline (1.0 eq) and the dye-sulfonyl chloride (2.0 g). The mixture was stirred overnight, poured into water and extracted with chloroform. The chloroform extracts were dried, the solvent removed by evaporation, and the solid was recrystallized from ethanol. Chromatography on silica gel with 5% acetonitrile in chloroform, then 25% acetonitrile in chloroform, and finally 50% acetonitrile in chloroform yielded 800 mg of desired Compound 1.

Synthesis of Compound 4

This example describes the preparation of Compound No. 4, a gem-dinitro compound that releases a magenta dye moiety. A schematic representation of the reactions involved is shown below:

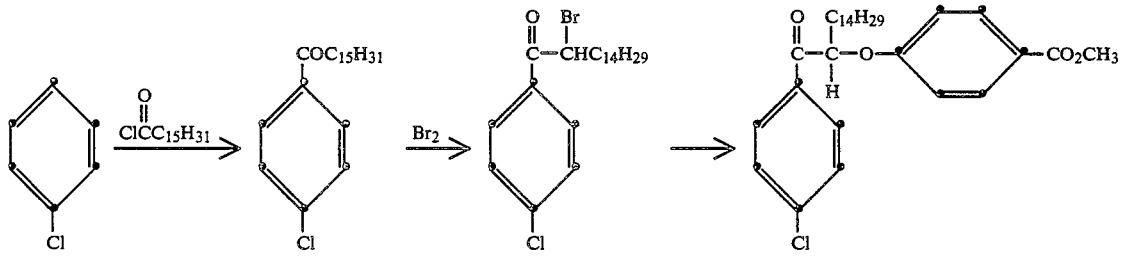

(4A) (4B) (4C)

-continued

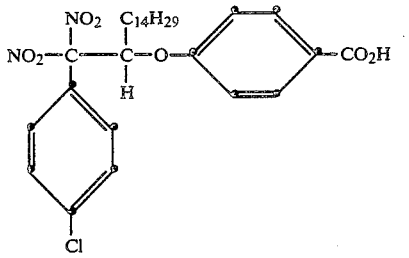

(4E)

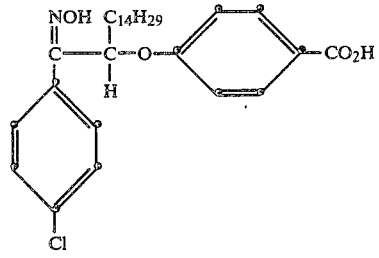

(4D)

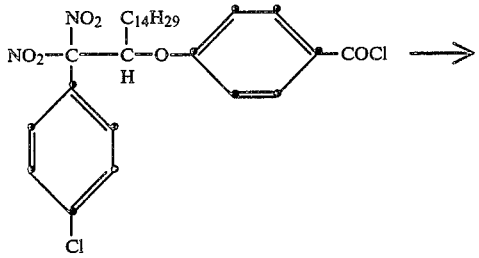

(4F)

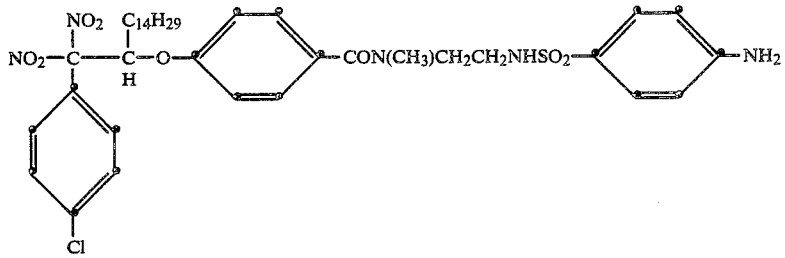

(4G)

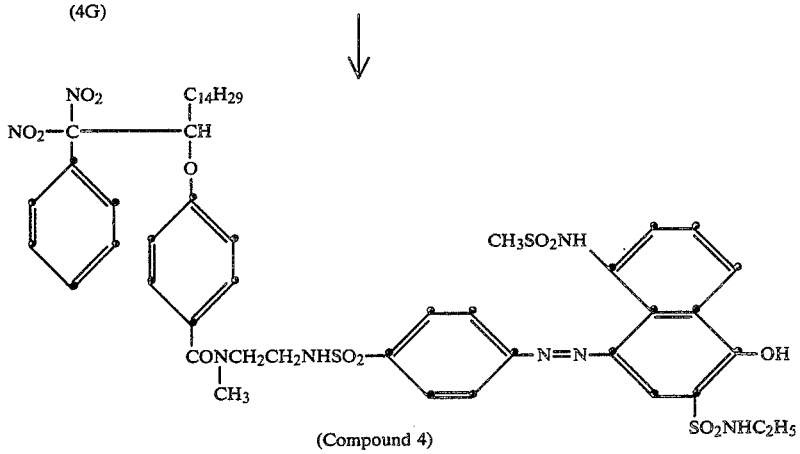

(Compound 4)

Intermediate 4A

Chlorobenzene (300 ml) and palmitoyl chloride (190 g) were mixed at room temperature. Aluminum chloride (100 g) was added and the resulting solution was heated to about 90° C. for 2½ hours. The warm solution was diluted to 2 liters with ethanol and cooled to room temperature to yield 208 g (85%) of the ketone 4A.

Intermediate 4B

4'-chlorohexadecanophenone, (80 g, 230 mmol) was dissolved in warm p-dioxane (400 ml) and a small amount of insoluble material was removed by filtration. To this warm solution bromine (32 g, 200 mmols) was added dropwise. When bromination was complete (thin-layer chromatography showed all of the starting ketone to be consumed), the solution was poured on a slurry of ice and water and the resulting solid was washed with water. The filter cake was taken up in dichloromethane (500 ml), the residual aqueous layer was removed, and the organic layer was dried over magnesium sulfate. After concentration of the mixture to 150 ml, n-hexane (150 ml) was added and the mixture was chilled to yield white crystalline 4B.

Intermediate 4C

To a solution of methyl 4-hydroxybenzoate (1.6 g, 100 mmol) in dimethylformamide (50 ml) was added sodium methoxide (0.55 g, 10. mmol). The mixture was heated to boiling to remove any methanol. Bromoketone intermediate, 4B (4.3 g, 10. mmol) in dimethylformamide (5 ml), was added dropwise to the warm solution. When the reaction was complete it was acidified with hydrochloric acid and poured onto cracked ice. Extraction with chloroform followed by concentration of the extracts and recrystallization of the residue from ethanol yielded 3.5 g of 4C.

Intermediate 4D

To a solution of the ester intermediate, 4C (4.1 g) in methanol (40 ml), was added 2 M sodium hydroxide (5 ml). After refluxing for 3 hours, additional 2 M sodium hydroxide (5 ml) was added. After refluxing one additional hour complete reaction was shown by thin-layer chromatography. Acidification with hydrochloric acid yielded a solid which was collected by filtration. The ketoacid was converted to its oxime by refluxing for 30 hours in ethanol (50 ml) with a slight excess of hydroxylamine hydrochloride and pyridine. The reaction mixture was poured onto ice water containing hydrochloric acid and the solid was collected, washed with water and dried. Infrared data were consistent with the proposed oxime 4D.

Intermediate 4E

The oxime intermediate, 4D (41 g), was slurried in diethyl ether (300 ml), chilled to −5° C., and a solution of concentrated nitric acid (200 ml) in water (100 ml) was added dropwise while maintaining the temperature below 0° C. A solution of sodium nitrite (40 g) in water (80 ml) was then slowly added below 0° C. The mixture was stirred below 10° C., for two hours, the ether layer was separated and washed successively with cold sodium acetate solution and cold water. Evaporation of the ether produced 40 g of 4E as an oil.

Intermediate 4F

Intermediate 4E (40. g) was dissolved in dichloromethane (200 ml). Oxalyl chloride (40 ml) and dimethylformamide (4 drops) were added with stirring at room temperature. After two hours of stirring the volatiles were removed under reduced pressure. Hexane (200 ml) was then added to the resulting oil and a white crystalline solid slowly precipitated. The solid was recrystallized from hexane to yield 12 g. Infrared, mass spectral and NMR data were consistent with the acid chloride 4F.

Intermediate 4G

A solution was made of triethylamine (1.2 g, 12 mmol) and N-[2-(4-aminobenzenesulfonamido)ethyl] methylamine (2.3 g, 10 mmol) in anhydrous tetrahydrofuran (100 ml). This solution was chilled to −60° C. and a solution of acid chloride intermediate 4F (5.7 g, 10 mmol) in anhydrous tetrahydrofuran (20 ml) was slowly added. The mixture was allowed to slowly warm to room temperature, most of the solvent was removed under vacuum and the residue was added to a mixture of ice, water and acetic acid.

A resulting gum was washed by decantation, was taken up in dichloromethane and dried over magnesium sulfate. Removal of solvent with vacuum yielded 7.5 g of a glass. The infrared spectrum was consistent with the structure of 4G.

Compound 4

A solution of the intermediate 4G (3.8 g, 5 mmol) dissolved in tetrahydrofuran (25 ml) was stirred while adding a second solution of gaseous hydrogen chloride (0.7 g, 20 mmol) in tetrahydrofuran (30 ml). This mixture was chilled to 0° C., and to it was added a solution of isopentyl nitrite (0.6 g, 5 mmol) in tetrahydrofuran (5 ml). This mixture was stirred for 15 minutes at 0° C. and was then added slowly to a solution of 2-ethylsulfamoyl-5-methanesulfonamido-1-naphthol (17.5 g) in pyridine (20. ml). A magenta color was rapidly generated. The mixture was stirred at 0° C. for 30 minutes, tetrahydrofuran was removed by vacuum and the remaining solution was added to a slurry of ice, water and acetic acid. A resulting dark gum was washed by decantation, dissolved in dichloromethane and dried over magnesium sulfate. The product was purified by chromatography on a silica gel column, eluting successively with mixtures of hexane/acetone/acetic acid (90/10/2 to 50/50/2). Solid product, 4.9 g (indicated purity 91% by HPLC), was obtained after removal of volatiles.

Calculated for $C_{51}H_{66}N_8O_{13}S_3$: C, 55.9; H, 6.1; N, 10.2; S, 8.8. Found: C, 53.8; H, 6.3; N, 9.5; S, 9.1. m/e, 1128.

Synthesis of Compound 9

This example describes the preparation of Compound No. 9, a gem-dinitro compound that releases a yellow dye moiety. A schematic representation of the reactions involved is shown below:

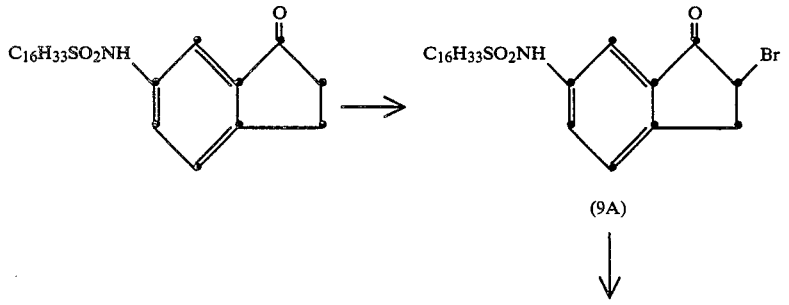

-continued

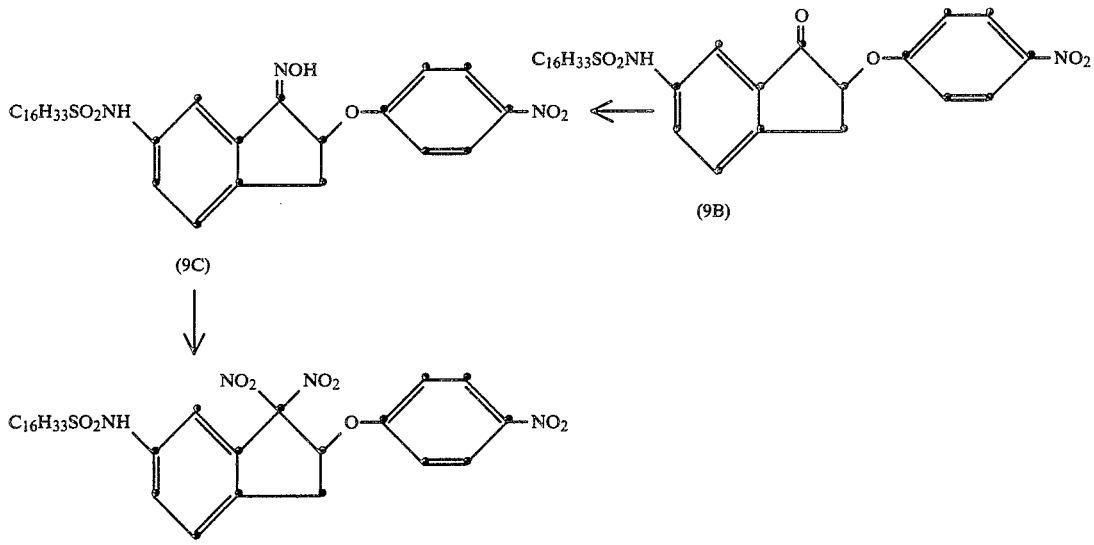

Intermediate 9A

A solution was made of 6-(hexadecanesulfonamido)indane-1-one (21.5 g, 1-mmol) in warm acetic acid (250 ml). To this solution bromine (8 g, 10 mmol) was added dropwise with vigorous stirring over a period of 3 minutes. After cooling overnight, crystals were deposited and filtered to yield 23 g of 9A.

Intermediate 9B

A mixture of the bromoketone intermediate 9A (23 g, 45 mmol) and sodium p-nitrophenoxide (9.6 g, 49 mmol) in dimethylformamide (100 ml) was slightly warmed with stirring until solution occurred. The mixture was then heated to 50° C. and allowed to cool spontaneously while stirring for 30 minutes. It was poured into water to form an oil, which was stirred and washed by decantation. The residue was dissolved in dichloromethane, dried over magnesium sulfate, and the crude material was purified by chromatography on silica gel, eluting with dichloromethane/acetonitrile (95/5). The resulting purified oil was crystallized from acetonitrile (65 ml) to yield 20 g of 9B.

Intermediate 9C

A mixture of ketone intermediate 9B (15 g, 27 mmol), hydroxylamine hydrochloride (2.5 g, 36 mmol) and pyridine (3 g, 38 mmol) in ethanol (100 ml) was refluxed for two hours. The solution was chilled and the resulting crystals were filtered to yield 10 g of 9C.

Compound 9

A slurry of 10 g of oxime intermediate 9C, dissolved in ether (200 ml), was chilled to 0° C. A mixture of nitric acid (40 ml) and water (20 ml) was added dropwise, with stirring. The temperature was maintained below 3° C. A solution of sodium nitrite (10 g) in water (25 ml) was added slowly at 3° C. The mixture was stirred for one hour at 0° C., the ether layer was removed, the remaining solution washed several times with a sodium acetate solution and then with water. Dichloromethane was added, the organic solution was dried over magnesium sulfate and chromatographed on silica gel, eluting with dichloromethane/acetonitrile (95/5). The product was concentrated to 1.1 g of a pale yellow gum. The infrared, NMR and mass spectral data were all consistent with the proposed structure of Compound 9.

Synthesis of Compound 13

This example describes the preparation of Compound No. 13, a gem-dinitro compound that releases a development restrainer moiety. A schematic representation of the reactions involved is shown below:

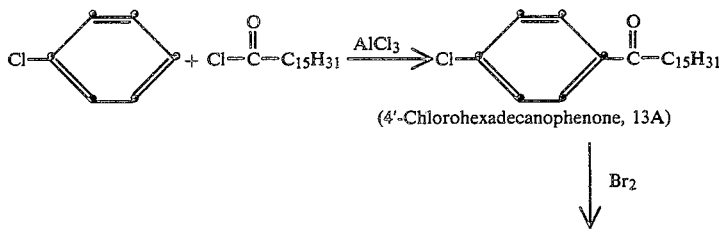

-continued

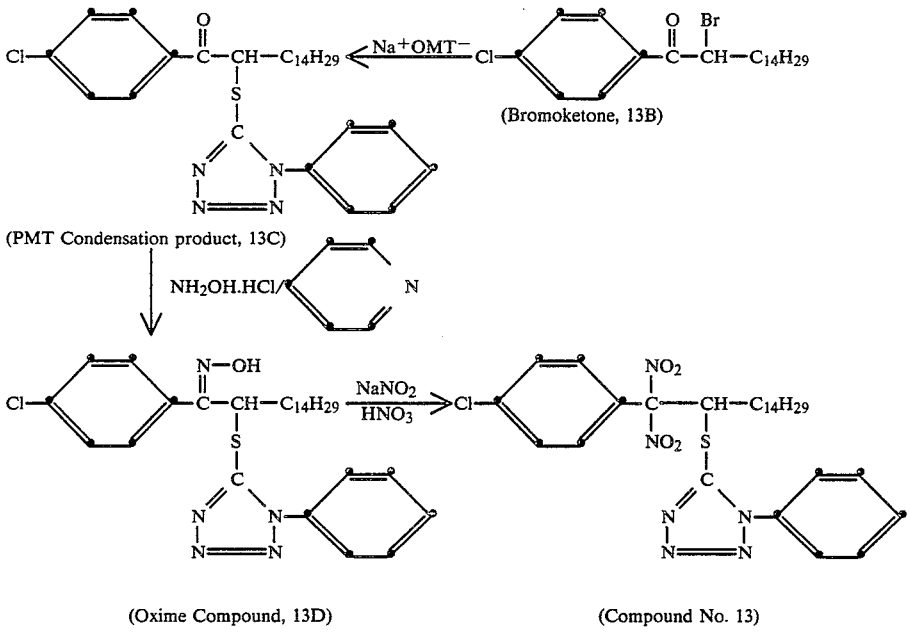

Synthesis of 4'-Chlorohexadecanophenone 13A

Chlorobenzene (300 ml) and palmitoy chloride (190 g) were mixed at room temperature. Aluminum chloride (100 g) was added and the resulting solution heated to about 90° C. for 2½ hours. The warm solution was diluted to 2 liters with ethanol and cooled to room temperature. The yield was 208 g (85 percent) of 13A.

Bromination of 13A to form 2-bromo-4'-chlorohexadecanophenone 13B

The ketone 13A (208 g) was warmed with one liter of dioxane. Insolubles were removed by filtration and bromine was added to the filtrate until thin layer chromotography on silica gel ($CCl_4$) indicated no remaining compound 1A. The reaction mixture was poured onto crushed ice, the solid was collected, dissolved in dichloromethane and dried over $MgSO_4$ to yield 250 g (98 percent) of brominated ketone 13B.

Preparation of Condensation product of PMT with 2-(1-phenyl-1H-tetrazol-5-ylthio)-4'-chlorohexadecanophenone 13C The bromoketone 13B (75 g) was dissolved in N,N-dimethylformamide. Solid 5-mercapto-1-phenyl-1H-tetrazole, sodium salt, (40 g) was added and the mixture stirred at room temperature (~21° C.) until thin layer chromatography showed complete reaction (about 2 hours). The resulting oil, 13C, was used in the next step without further treatment.

Preparation of the oxime 13D

To a solution of 13C in ethanol were added 24 g (0.3 mol) pyridine and 28 g (0.4 mol) $NH_2OH.HCl$. The solution was warmed at about 40° C. for 24 hours. The solvent was removed in a rotary evaporator and the solid which formed was filtered. The remaining oil was dissolved in dichloromethane. This solution was extracted with water, then with saturated NaCl and dried over $MgSO_4$. The resulting 73 g represented a 77 percent yield of 13D.

Preparation of 5-[1-p-chlorophenyl)-1,1-dinitrohexadec-2-ylthio]-1-phenyl-1H-tetrazole, Compound No. 13

The oxime 13D (67 g) was dissolved in 300 ml of ether contained in a flask equipped for mechanical stirring. The solution was cooled in an ice-salt bath while a solution of 200 ml conc. $HNO_3$ in 100 ml water was added dropwise at a rate to maintain the temperature at −5° to +2° C. After this addition, 60 g of $NaNO_4$ in 120 ml of water were added dropwise. About two hours after the addition was complete, the ether layer was separated from the acid, washed successively with cold sodium acetate and cold saturated NaCl, and then dried over $MgSO_4$ with an air stream to remove gases. After chromatography, 45 g of 1D were isolated which contained less than 0.005 percent of the free phenylmercaptotetrazole.

EXAMPLE 1

Released Dye Where Z is Hydrogen

Single color photographic elements were prepared by coating the following layers, in the order recited, on a poly(ethylene terephthalate) film support. The amounts of components are indicated parenthetically in $g/m^2$.

ELEMENT A (1) green-sensitive, negative-working, silver bromide emulsion (1.08 silver), gelatin (2.16), magenta positive redox dye-releasing (PRDR) Compound No. 1 (0.72) and diethyllauramide (0.72); and
(2) gelatin (1.08) overcoat

ELEMENT B (1) blue-sensitive, negative-working, silver bromide emulsion (1.08 silver); gelatin (2.16), yellow PRDR Compound No. 2 (0.60) and diethyllauramide (0.60); and
(2) gelatin (1.08) overcoat.

Each element was tested by fogging one half and by fixing the other half. The element was then laminated to a receiving sheet which comprised a poly(ethylene terephthalate) support having coated thereon an image-receiving layer comprising poly(styrene-co-N,N,N-tri-n-hexyl-N-vinylbenzylammonium chloride) (50:50 by weight) (2.3) and gelatin (2.3). The following processing composition was spread between the element and the receiving sheet:

| | |
|---|---|
| Potassium Hydroxide | 51 g/l |
| 1-Phenyl-4-hydroxymethyl-4-methyl-3-pyrazolidone | 3 g/l |
| Carboxymethyl cellulose | 40 g/l |

Each element was then cut into five strips which were sequentially peeled apart and washed after 1, 3, 5, 10 and 20 minutes. Each strip has the fixed-fog information at a particular time. Plotting dye density versus time yields a fixed-fog curve from which $t-\frac{1}{2}$ in seconds can be determined as the time required to reach one-half the maximum density.

The following Table lists the $t-\frac{1}{2}$ values, in seconds, for each compound. The Table also lists values of maximum and minimum densities obtained for a 10-minute transfer at 49° C.

TABLE I

| Element | Concentration moles/m$^2$ | t-½ | Density Dmin | Dmax |
|---|---|---|---|---|
| A | $6.5 \times 10^{-6}$ | 84 | 0.17 | 0.9 |
| B | $4.6 \times 10^{-6}$ | 60 | 0.1 | 0.47 |

EXAMPLE 2

Released Dye Where Z is Not Hydrogen

Single color photographic elements were prepared by coating the layers indicated below, in the order recited, on a poly(ethylene terephthalate) film support. The amount of each component is listed parenthetically in g/m$^2$.

ELEMENT C (1) gelatin (2.16)
(2) red-sensitive, negative working, silver bromide emulsion (1.08 silver), gelatin (2.16), cyan PRDR Compound No. 6 (0.234), electron donor (1) (0.468) and diethyllauramide (0.70)
(3) gelatin (2.16) overcoat

ELEMENT D (1) gelatin (2.16)
(2) green-sensitive, negative working, silver bromide emulsion (1.08 silver), gelatin (2.16), magenta PRDR Compound No. 4 (0.207), electron donor (1) (0.414) and diethyllauramide (0.621)
(3) gelatin (2.16) overcoat

ELEMENT E (1) gelatin (2.16)
(2) blue-sensitive, negative working, silver bromide emulsion (1.08 silver), gelatin (2.16), yellow PRDR Compound No. 5 (0.272), electron donor (1) (0.544) and diethyllauramide (0.816)
(3) gelatin (2.16) overcaot (1) Electron donor precursor Compound 13 of U.S. Pat. No. 4,278,750.

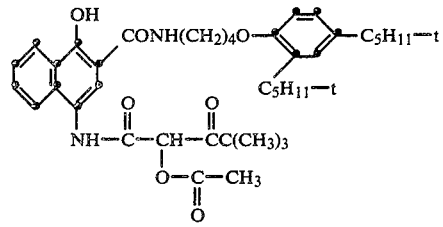

Each element was laminated to a receiving sheet and subjected to a processing composition as described in Example 1.

The following Table lists the $t-\frac{1}{2}$ values, in second, for each compound. The table also lists values of minimum and maximum densities obtained for three-minute transfers at 49° C.

TABLE 2

| Element | t-½ | Density Dmin/Dmax |
|---|---|---|
| C | <20 | 0.12/0.98 |
| D | <20 | 0.02/1.45 |
| E | <20 | 0.09/1.12 |

EXAMPLE 3

Release of Dye where Z is Not Hydrogen

Single color photographic elements were prepared as described above in Example 2, Element E. The PRDR compounds identified below were used in place of Compound No. 5. The processing composition was as described in Example 1. Resulting $t-\frac{1}{2}$ values are reflected in Table 3.

TABLE 3

| PRDR Compound No. | t-½, seconds |
|---|---|
| 7 | 30 |
| 9 | <20 |
| 10 | 130 |

EXAMPLE 4

Release of Dye where Z is Not Hydrogen

A single color photographic element was prepared and processed as described in Example 2, Element D, except that PRDR Compound 8 was substituted for Compound No. 4. Good imaging properties resulted with a $t-\frac{1}{2}$ value of 80 seconds being obtained.

This invention has been described in detail with particular reference to preferred embodiments thereof. However, it will be apparent that variations and modifications can be effected within the spirit and scope of the invention.

What is claimed is:

1. A photographic element comprising a support having thereon at least one photosensitive silver halide emulsion layer having associated therewith a nondiffusible compound capable of releasing a diffusible photographically useful group in an imagewise manner by a $\beta$-elimination reaction which compound has the structural formula:

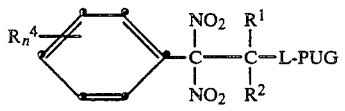

wherein $R^1$ and $R^2$ are each independently hydrogen, a saturated or an unsaturated, unsubstituted or a substituted, straight or branched chain aliphatic group having from 1 to about 30 carbon atoms;

an alicyclic group having from 4 to about 30 total carbon atoms;

a heterocyclic group having from 5 to 7 atoms in the heterocyclic ring;

an aromatic group, which may be substituted, having from 6 to about 30 carbon atoms;

or at least one of $R^1$ and $R^2$ and the carbon atom to which they are attached can constitute the atoms necessary to form a mono- or a poly-cyclic group having 5 or 6 atoms in each ring;

with the proviso that at least one of $R^1$, $R^2$ or of $R^4$ along with the phenyl group to which it is attached represents a ballast group;

$R^4$ is chloro, nitro, an unsubstituted or a substituted alkyl group having from 1 to about 22 total carbon atoms, $—SO_2R^5$ or $—SO_2NHR^5$;

$R^5$ is an unsubstituted or a substituted alkyl group having from 1 to about 6 total carbon atoms;

n is an integer of from 0 to 3;

L is a leaving group; and

PUG is a photographically useful group.

2. The photographic element of claim 1 wherein L is oxygen, sulfur or nitrogen.

3. The photographic element of claim 1 wherein L is a divalent saccharin group.

4. The photographic element of claim 1 wherein L is a divalent phthalimide group.

5. The photographic element of claim 1 wherein $R^1$ represents a straigth chain alkyl group having from about 10 to about 22 carbon atoms.

6. The photographic element of claim 1 wherein PUG is a dye or a dye precursor, a development inhibitor, a development accelerator, a bleach inhibitor, a bleach accelerator, a developing agent, a silver halide solvent, a silver complexing agent, a fixing agent, a toning agent, a hardening agent, a fogging or an antifogging agent or a chemical or a spectral sensitizing or desensitizing agent.

7. The photographic element of claim 1 wherein said nondiffusible compound is:

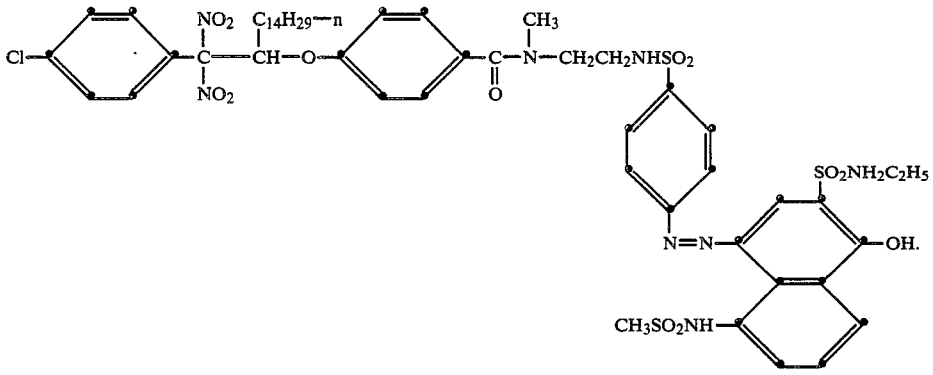

8. The photographic element of claim 1 wherein said nondiffusible compound is:

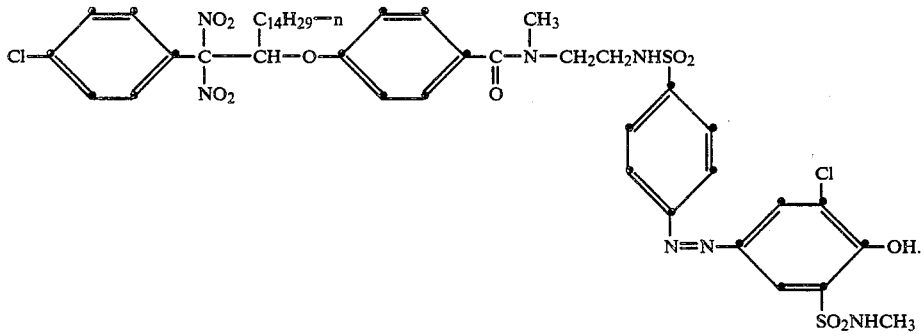

9. The photographic element of claim 1 wherein said nondiffusible compound is:

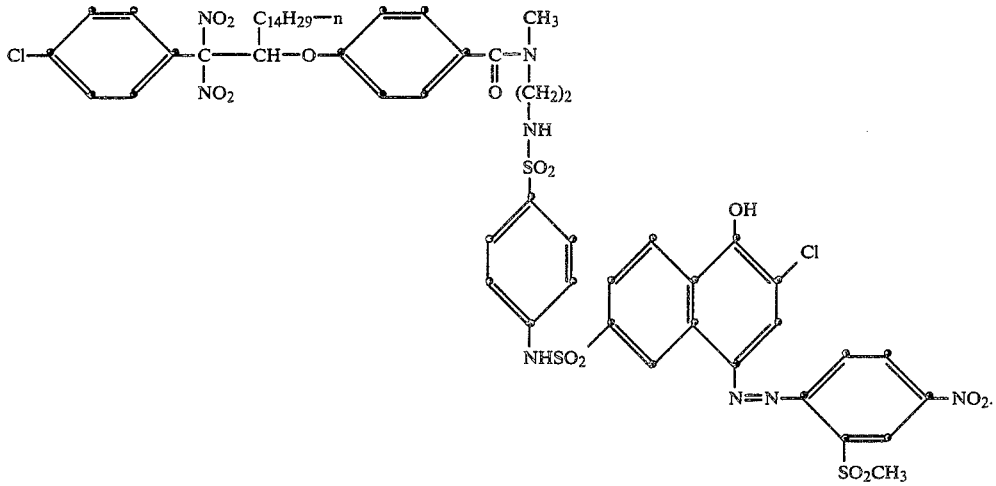

10. The photographic element of claim 1 wherein said nondiffusible compound is:

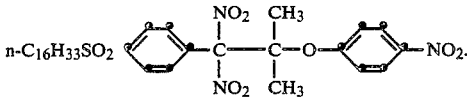

11. The photographic element of claim 1 wherein said nondiffusible compound is:

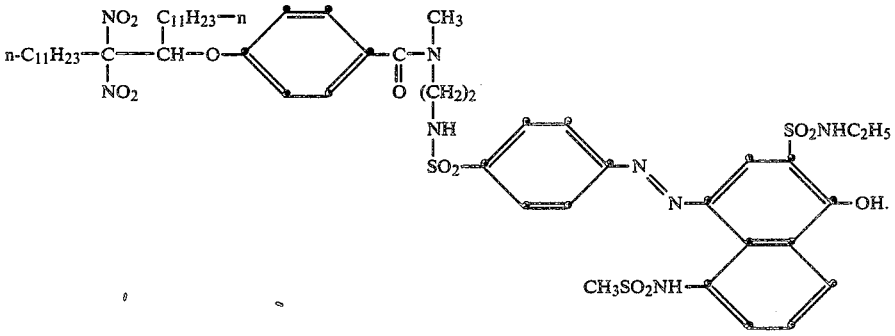

12. The photographic element of claim 1 wherein said nondiffusible compound is:

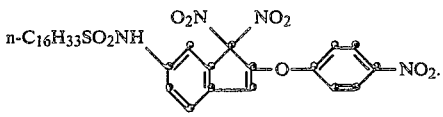

13. The photographic element of claim 1 wherein said nondiffusible compound is:

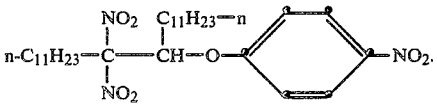

14. The photographic element of claim 1 wherein said nondiffusible compound is:

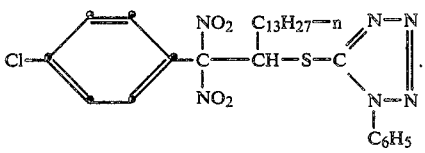

15. The photographic element of claim 1 wherein said nondiffusible compound is:

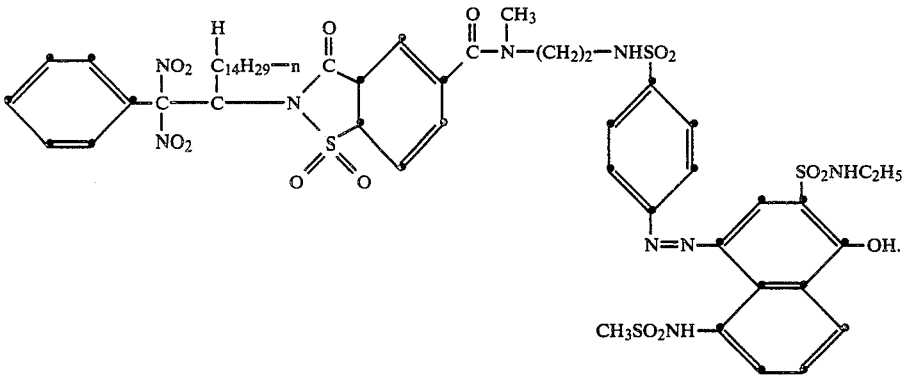

16. The photographic element of claim 1 wherein said nondiffusible compound is:

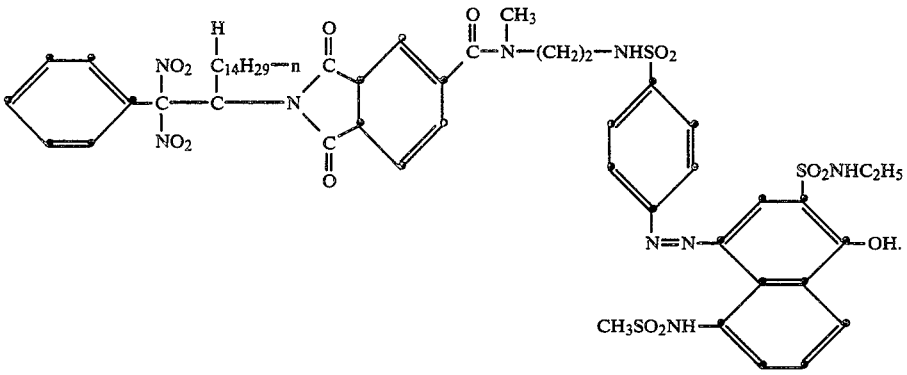

17. A photographic assemblage comprising:
(a) a photographic element according to claim 1;
(b) a dye image-receiving layer; and
(c) an alkaline processing composition with means for discharging same within said assemblage;

said assemblage also comprising a silver halide developing agent and an electron donor compound.

* * * * *